US006454245B2

(12) United States Patent
Kobayashi

(10) Patent No.: US 6,454,245 B2
(45) Date of Patent: Sep. 24, 2002

(54) ENGINE INTAKE CONTROL MECHANISM

(75) Inventor: Fujio Kobayashi, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/778,145

(22) Filed: Feb. 7, 2001

(30) Foreign Application Priority Data

Feb. 10, 2000 (JP) ..... 2000-033802

(51) Int. Cl.[7] ..... F02M 1/02
(52) U.S. Cl. ..... 261/52; 261/64.6
(58) Field of Search ..... 261/52, 64.6; 123/179.18, 123/185.1, 436, 339.13

(56) References Cited

U.S. PATENT DOCUMENTS

| | | | | | |
|---|---|---|---|---|---|
| 2,339,867 | A | * | 1/1944 | Mann, Jr. | 261/52 X |
| 2,977,101 | A | * | 3/1961 | Carlson | 261/52 X |
| 3,305,223 | A | * | 2/1967 | Reichenbach | 261/52 |
| 3,575,385 | A | * | 4/1971 | Szwargulski et al. | 261/52 X |
| 3,740,040 | A | * | 6/1973 | Brown, III et al. | 261/52 X |
| 3,807,709 | A | * | 4/1974 | Suda et al. | 261/52 X |
| 3,965,224 | A | * | 6/1976 | Freismuth | 261/52 X |
| 4,113,808 | A | * | 9/1978 | Hackbarth et al. | 261/52 |
| 4,123,480 | A | | 10/1978 | Johansson | 261/52 |
| 4,169,872 | A | * | 10/1979 | Latz et al. | 261/52 |
| 4,181,107 | A | * | 1/1980 | Nomura et al. | 261/52 X |
| 4,192,834 | A | * | 3/1980 | Berkbigler | 261/52 |
| 4,196,156 | A | * | 4/1980 | Rogerson et al. | 261/52 X |
| 4,351,782 | A | * | 9/1982 | Bellicardi et al. | 261/52 X |
| 4,439,377 | A | * | 3/1984 | Nartowski | 261/52 |
| 4,490,309 | A | * | 12/1984 | Fujikawa et al. | 261/52 |
| 4,773,362 | A | * | 9/1988 | Wissmann et al. | 261/52 X |
| 5,500,159 | A | * | 3/1996 | Martinsson | 261/52 |
| 5,611,312 | A | * | 3/1997 | Swanson et al. | 261/52 X |
| 6,000,683 | A | * | 12/1999 | Van Allen | 261/52 |
| 6,202,989 | B1 | * | 3/2001 | Pattullo | 261/52 |

FOREIGN PATENT DOCUMENTS

| | | |
|---|---|---|
| JP | 05195891 | 8/1993 |
| JP | H839502 | 2/1996 |

* cited by examiner

*Primary Examiner*—Richard L. Chiesa
(74) *Attorney, Agent, or Firm*—Baker Botts L.L.P.

(57) ABSTRACT

An engine intake control mechanism has a throttle valve that can be rotated to a cold-starting position in response to the closing movement of a choke valve and, even if the throttle valve is opened beyond the cold-starting position, the choke valve is retained at the cold-starting position. Only when the throttle valve is subsequently actuated to return to its original closed position is the choke valve automatically returned to its original opened position. The engine intake control mechanism is especially useful in top handle type portable power working machines, which are subject to undesirable movements of the throttle control lever on the top handle when the engine is being started.

7 Claims, 11 Drawing Sheets

ENGINE INTAKE CONTROL MECHANISM

BACKGROUND OF THE INVENTION

The present invention relates to an engine intake control mechanism that has a throttle valve and a choke valve for controlling the quantity of an air/fuel mixture inducted into an internal combustion engine. In particular, the present invention relates to an engine intake control mechanism in which the throttle valve is rotated to a cold-starting position in association with the choke valve at the time of cold-starting, and the choke valve is automatically returned to its original opened position after the engine is started.

In the operation of a fuel/air mixing device, such as the carburetor of an internal combustion engine that powers a portable power working machine, for example, a chain saw, it is required when the engine is first started, especially in cold weather, that a fuel/air mixture of relatively rich composition be fed to the engine since the vaporization of fuel is poor when the engine is cold. Therefore, a choke valve is positioned upstream from the venturi portion of the air inlet passageway of the carburetor and is brought to its closed position by rotating the choke to the cold-starting position at the time of cold-starting, thereby greatly reducing the quantity of inducted air and at the same time increasing the negative pressure of the venturi portion of air inlet passageway, thus increasing the quantity of fuel drawn from the fuel supply by the air flow.

For an engine intake control device provided with such a choke valve, a previously known auto-return type device, as shown in Japanese Patent Unexamined Publication S52-104642 (U.S. Pat. No. 4,123,480), is constructed such that at the time of cold-starting, the throttle valve is rotated to the cold-starting position —a slightly rotated position in the opening direction from its idling position —in response to the closing movement of the choke valve. After the engine starts, the throttle valve is actuated so as to increase the opening degree thereof, thereby enabling the choke valve to automatically return to its original opened position.

In a portable power working machine, such as a chain saw, there is previously known a so-called top handle-type power working machine, examples of which are shown in Japanese Patent Unexamined Publication H5-195891 and Japanese Patent No. 2931234. Such machines have a top handle that is attached to the top surface of the main body housing for the internal combustion engine and a side handle that is attached to the sidewall of the main housing. A lock-canceling lever for canceling a lock device, which is designed to lock the throttle valve in its idling position, protrudes from the top surface of the top handle. A throttle lever for rotating the throttle valve is attached to the underside of the front end of the top handle. A recoil starter handle for starting the engine protrudes upwardly from the left sidewall of the main housing.

If the aforementioned conventional auto-return type engine intake control device were to be used in the aforementioned portable power working machine of the top handle type, the following problems would be presented:

At the time of cold-starting of the power working machine, especially when the operator is in unstable position such as working on a tree, the operator is required first to manipulate the choke controlling element, such as thumbscrew or lever attached to the main housing, to rotate the choke valve from its opened position to the partly closed, cold-starting position. Then, the user needs to grip the top handle with his right hand and at the same time to pull the recoil starter handle with his left hand so as to start the engine. When operator grips the handle, the lock canceling lever that protrudes from the top of the top handle is inevitably squeezed and caused to rotate in the lock-canceling direction. Also, the operator may inadvertently touch the throttle valve. As a result, the throttle lever is caused to rotate in the direction to increase the opening degree of the throttle valve. Hence, the choke valve is caused to return from the coldstarting position to its original opened position, thereby raising the problem that the cold-starting performance of the engine would be deteriorated because the intake passageway of the carburetor cannot be sufficiently constricted for enabling the cold-starting.

BRIEF SUMMARY OF THE INVENTION

The present invention is directed to solving the aforementioned problems. It is, therefore, an object of the present invention to provide an engine intake control mechanism which is constructed such that the throttle valve can be rotated so as to bring it into the cold-starting position in response to the closing movement of the choke valve at the time of cold-starting and then, with the throttle valve locked in the cold-starting position, the choke valve is retained at the cold-starting position even if the throttle valve is actuated by the operator to increase the opening degree of the throttle valve. In addition, when the throttle lever that has been once gripped is released to thereby enable the throttle valve to return to its closed position, the choke valve is allowed to automatically return to its original position. By meeting the foregoing objectives, the engine intake control mechanism is well suited for use in a portable power working machine of top handle type.

With a view to attaining the aforementioned object, there is provided, according to the present invention, an engine intake control mechanism that includes a throttle valve and a choke valve, which are positioned in an intake passageway of an air/fuel mixing device adapted to be mounted on an internal combustion engine. A first throttle control lever is coupled for rotation with a rotatable shaft of the throttle valve. A second throttle control lever is rotatable about an axis of the rotatable shaft of the throttle valve. A throttle return spring urges the throttle valve to rotate in the closing direction thereof. A coupling spring links the first throttle control lever to the second throttle control lever to enable the first throttle control lever and the second throttle control lever to rotate together. A choke control unit is coupled for rotation with a rotatable shaft of the choke valve. A choke return spring urges the choke valve to rotate in the opening direction thereof.

The choke control unit is arranged such that: (1) when the choke control unit is rotated together with the choke valve so as to move the choke valve into a cold-starting position, the first throttle control lever together with the throttle valve and the second throttle control lever are caused to rotate in response to the rotation of the choke control unit so as to position the throttle control valve in a cold-starting position; (2) the choke control unit and the first throttle control lever are interlocked with each other so as to retain the cold-starting positions thereof against the biasing forces of the choke return spring and of the throttle return spring; and (3) when the first throttle control lever is further rotated from the interlocked state in a direction to increase the opening degree of the throttle valve, the first throttle control lever is disengaged from the choke control unit and at the same time the choke control unit is engaged with the second throttle control lever, thereby interlocking the choke control unit with the second throttle control lever at the cold-starting position.

It is preferred in the engine intake control mechanism according to the present invention that the coupling spring be a torsion coil spring, which is interposed between the first throttle control lever and the second throttle control lever.

In a preferred embodiment of the present invention, the first throttle control lever is provided with a first throttle side engaging portion, which is arranged to be engaged with the choke control unit, and a press-engaging portion, which is arranged to be releasably engage the second throttle control lever by the biasing force of the coupling spring. The second throttle control lever is provided with a second throttle side engaging portion which is arranged to be engaged with the choke control unit.

In another preferred embodiment of the present invention, the choke control unit is provided with a first choke side engaging portion, which is arranged to be engaged with the first throttle side engaging portion of the first throttle control lever, and a second choke side engaging portion, which is arranged to be engaged with the second throttle side engaging portion of the second throttle control lever. In a further preferred embodiment of the present invention, the choke control unit is provided with a first choke control lever, which is arranged to be rotated integral with the rotatable shaft of the choke valve, and a second choke control lever, which is arranged to be rotated about an axis of the rotatable shaft of the choke valve. The second choke control lever is provided with the first choke side engaging portion and the second choke side engaging portion, the first choke control lever being urged by means of the choke return spring and via the second choke control lever to move in the direction to open the choke valve.

Preferably, the choke return spring is a torsion coil spring, which is interposed between a main body of the air/fuel mixing device and the second choke control lever.

When an engine intake control mechanism constructed as described above and according to the present invention is used with an internal combustion engine of a top handle type portable working power machine, the operator first manipulates the choke controlling member, such as a thumbscrew or lever attached to the main housing of the machine, so as to rotate the choke control unit and the first and second choke control levers against the forces of the choke return spring and the throttle return spring and to thereby bring the choke valve and the throttle valve into their cold-starting positions.

In particular, the choke valve is caused to rotate with the choke control unit, thereby moving it from its normal open position to the cold-starting, nearly closed position. At the same time, the choke control unit engages the first throttle control lever so as to rotate the first throttle control lever, against the bias of the throttle return spring, from a position for idling of the engine into the cold-starting position, in which the throttle valve is slightly opened from the idling position.

As the first throttle control lever is moved to the cold-starting position, the throttle valve rotates with the first throttle control lever so as to move it into the cold-starting position. At the same time, the second throttle control lever, which is linked by the linking spring, such as a torsion coil spring, to the first throttle control lever, is also rotated so as to bring it into the cold-starting position. Ultimately, the choke control unit and the first throttle control lever are interlocked with each other so as to retain the cold-starting positions thereof against the biasing forces of the choke return spring and the throttle return spring.

When the choke is thus set, the operator grips the top handle of the machine with his right hand and pulls the recoil starter handle with his left hand to start the engine. When the operator grasps the top handle, he is apt to also move the throttle lever attached to the top handle, which causes the first throttle lever to rotate, via a linkage member such as a cable or a link rod, from the locked state of the throttle valve in a direction to increase the opening degree of the throttle valve from the cold-starting choke position.

When the first throttle control lever moves from the cold-starting position as mentioned above, the first throttle control lever is permitted to disengage from the choke control unit. However, simultaneously with the disengagement, the choke control unit engages the second throttle control lever, so that the second throttle control lever and the choke control unit become interlocked with each other so as to retain the cold-starting position of the throttle valve. Even if the throttle lever is forced to rotate toward open from the cold-starting position, as described above, the second throttle control lever and the choke control unit remain in their interlocked state. The first throttle control lever, however, is able to rotate against the biasing force of the coupling spring.

As a result of these operations, the engine can be started and brought into a state in which combustion will be sustained and the engine speed increased, thus completing a cold start.

Thereafter, when the operator releases the throttle lever, the first throttle control lever is forced to rotate by the biasing forces of the throttle return spring and the coupling spring, in a direction to close the throttle valve. At that point, the throttle valve the second throttle control lever return to the idling positions. Thereupon, the choke control unit is released from its locked state, thereby enabling it to return at the urging of the choke return spring, to its original normal rest position in which the choke valve is open. The choke-actuating member is also permitted to return to its original position.

Subsequently, when the throttle lever is gripped again by the operator under the condition wherein the chokeactuating member and the choke control unit reside in their normal rest positions, the first throttle control lever as well as the second throttle control lever are forced to rotate, without being engaged with the choke control unit, in the direction to open the throttle valve to a suitable extent, depending on the magnitude of the rotation of the throttle lever.

With the engine intake control mechanism of the present invention, the throttle valve is at the time of cold-starting be rotated in response to the closing movement of the choke valve so as to bring it into the cold-starting position thereof, and at the same time, even if the throttle valve is actuated so as to increase the opening degree thereof, the choke valve can be retained at the cold-starting position. Thereafter, only when the throttle valve is actuated to return to its original closed position the choke valve is automatically returned to its original opened position. Therefore, the engine intake control mechanism of the present invention is well-suited for use in top handle type portable power working machines, inasmuch as it improves the cold-starting operation of such machines.

For a better understanding of the present invention, reference may be made to the following description of an exemplary embodiment, taken in conjunction with the accompanying drawings.

DETAILED DESCRIPTION OF THE INVENTION

Figure 10:
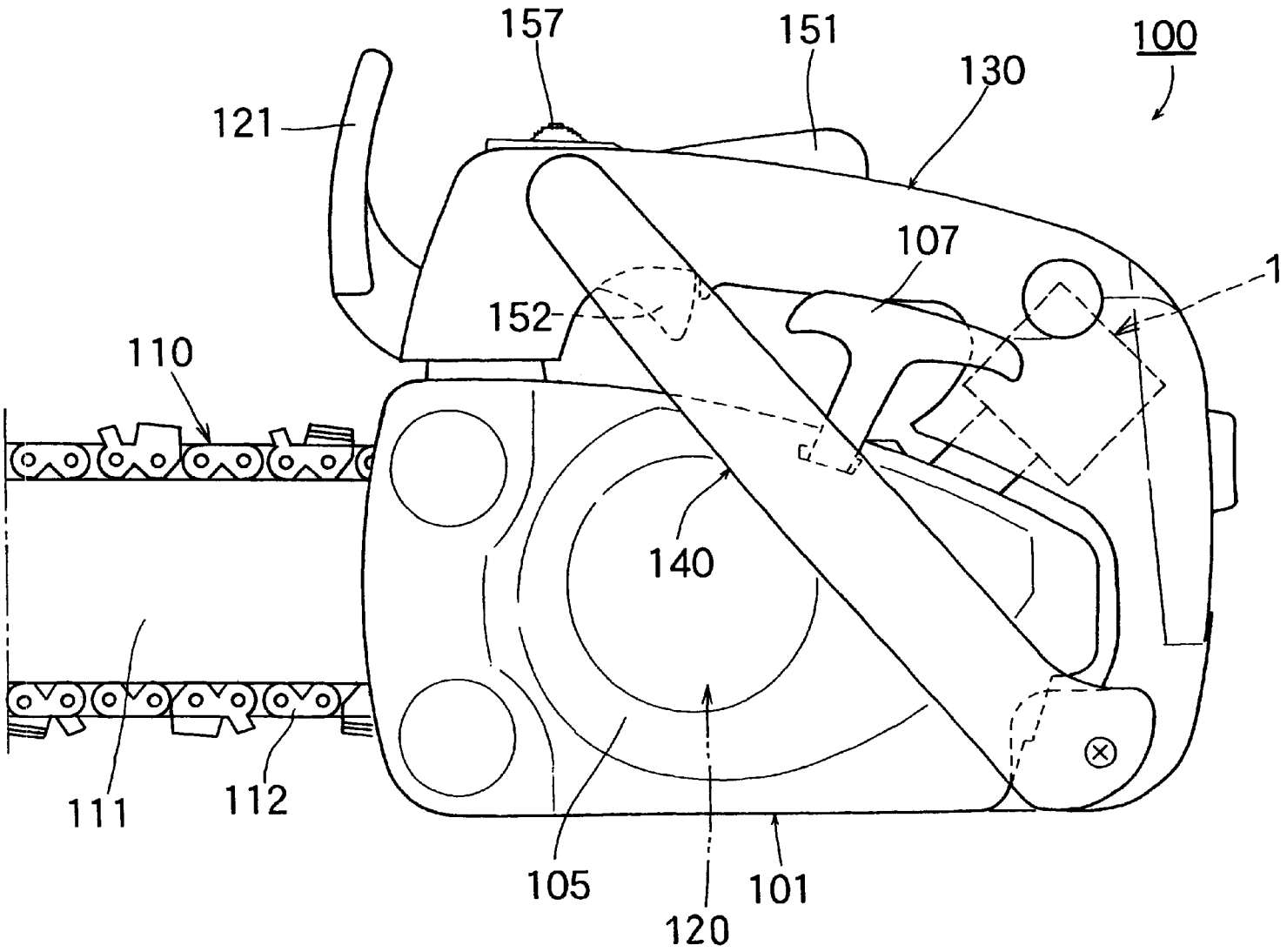
FIG. 10 is a left side view of a chain saw, the engine of which has the engine intake control mechanism shown in FIG. 1.
Figure 11:
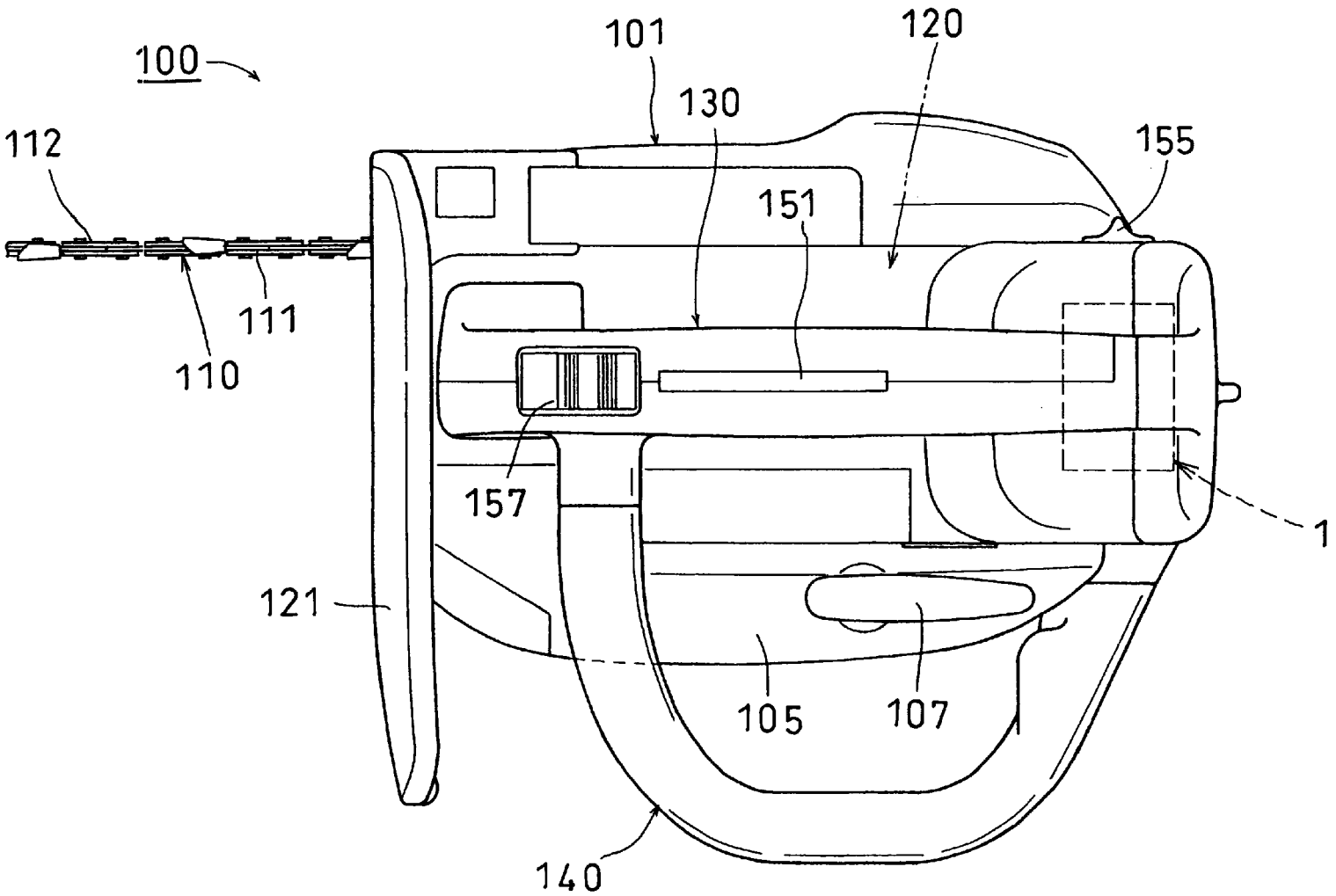
FIG. 11 is a plan view of the chain saw shown in FIG. 10.

Referring first to FIGS. 10 and 11, the engine intake control mechanism 10 is associated with a diaphragm type carburetor 1 that supplies an air/fuel mixture to an air-cooled two-stroke gasoline engine 120, which is mounted on a chain saw 100. The chain saw 100 is exemplary of a top handle type portable power working machine.

The chain saw 100 has a main housing 101 for the engine 120. A saw chain set 110, consisting mainly of a guide bar 111 and a saw chain 112 which is wound around the guide bar 111, is driven by the engine 120. The saw chain set 110 extends forwardly from the front wall of the main housing 101. A hand guard 121 is disposed over the front end portion of the main housing 101. A top handle 130 extends longitudinally over the top surface of the main housing 101 and downwardly along to the rear wall of the main housing 101. A side handle 140 is located on the left side of the main housing 101, both ends of the side handle 140 being coupled with the top handle 130. A recoil starter handle 107 for starting the internal combustion engine 120 is attached to the main housing 101 in such a manner that it projects upwardly from the left side wall portion of a recoil starter case 105. An engine stop switch 157 projects upwardly from of the front upper end portion of the top handle 130. A lock canceling lever 151 for canceling a device (not shown) that locks a throttle valve 20 in the idling position projects upwardly from the central portion of an upper surface of the top handle 130. The throttle valve 20 is located on the downstream side of a venturi tube portion 16 of an intake passageway 15 in the carburetor 1. A throttle lever 152 functioning as a throttle-actuating member for rotatably opening or closing the throttle valve 20 is located near the front end of the underside surface of the top handle 130.

A rotatable choke on-off thumbscrew 155, which is located on the right side of a rear end portion of the main housing 101, serves as a choke-actuating member for effecting the on-off movements of a choke valve 30. The choke valve 30 is disposed on the upstream side of the venturi tube portion 16 of an intake passageway 15 of the carburetor 1.

The engine intake control mechanism 10, which is installed on the carburetor 1, has a first throttle control lever 41 that is affixed by a screw 23 to a large diameter portion 21*a* at one end of a rotatable shaft 21 of the throttle valve 20. A second throttle control lever 42 is rotatably received on the large diameter portion 21*a* of the rotatable shaft 21 so that it can rotate about an axis Oa of the large diameter portion 21*a*. A throttle return coil spring 25 biases the throttle valve 20 in the direction to close the throttle valve 20. A torsion coil spring 40, which serves as a coupling spring, is interposed between the first throttle control lever 41 and the second throttle control lever 42. The coupling spring 40 elastically links the throttle control levers 41 and 42 so that they rotate together but can also move relative to each other against the bias of the torsion coil spring 40. A choke control unit 60 is fitted on and secured by means of a screw 33 to a portion 31*a* of an oval cross-section of a rotatable shaft 31 of the choke valve 30. A torsion coil spring 80 functioning as a choke return spring biases the choke valve 30 to rotate in the opening direction thereof.

Figure 2:
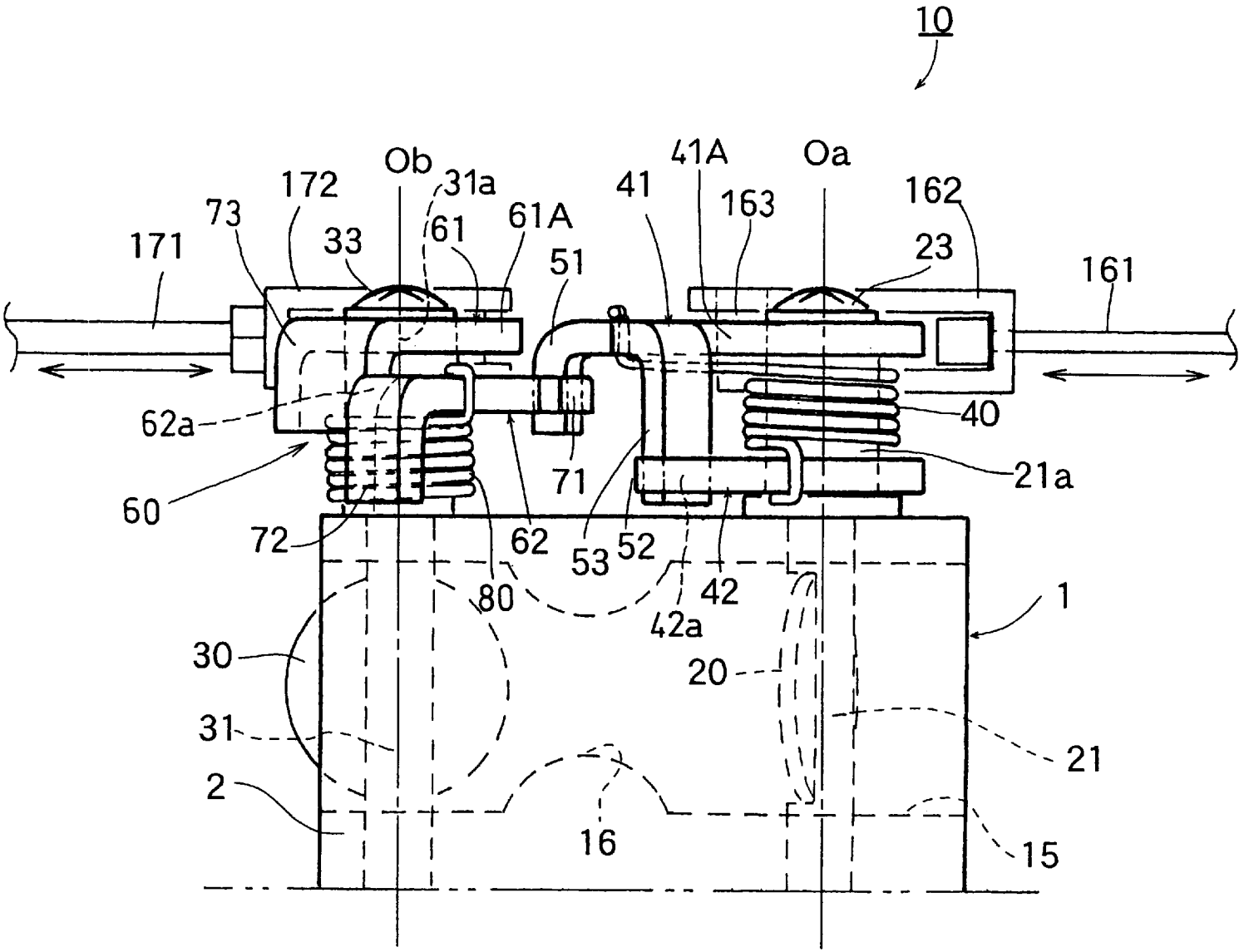
FIG. 2 is a view of the engine intake control mechanism of FIG. 1, as it is seen from the arrow II in FIG.1.

The first throttle control lever 41 has a lever portion 41A to which movements of the throttle lever 152 are transmitted by a linkage member 161, e.g., a cable or link rod, a coupling 162 and a link pin 163. A first throttle side engaging portion 51 protrudes leftwardly from the lever portion 41A and has an orthogonally bent distal end portion directed downwardly toward a main body 2 of the carburetor 1, thus forming an L-shaped configuration in side profile (see FIG. 2). A press-engaging portion 53 extends counterclockwise from the first throttle side engaging portion 51 and has an orthogonally downwardly bent distal end portion directed toward the main body 2 of the carburetor 1, thus forming an L-shaped configuration in side profile. The press-engaging portion 53 is engageable with an inner end face 42*a* of the second throttle control lever 42 by an urging force of the torsion coil spring 40.

The second throttle control lever 42 is provided with a second throttle side engaging portion 52 arranged to be engaged with a second choke side engaging portion 72 (described hereinafter) formed on the second choke control lever 62 of the choke control unit 60.

The throttle return coil spring 25 (see FIG. 1) is interposed between a return lever 26 secured to the other end of the rotatable shaft 21 of the throttle valve 20 and a spring-engaging pin 27 that protrudes from the main body 2 of the carburetor 1, so that when the throttle lever 152 rests in its released state, the return lever 26 is moved by the throttle return coil spring 25 to an idling position of the throttle valve 20 with an opening degree of idling, in which the return lever 26 contacts the tip end 28 of an idle adjuster screw (not shown) on the main body 2.

The choke control unit 60 has a first choke control lever 61, which is affixed to the rotatable shaft 31 of the choke valve 30 for rotation therewith, and the second choke control lever 62, which is arranged to rotate about an axis Ob of the rotatable shaft 31 of the choke valve 30. The second choke control lever 62 has: a first choke side engaging portion 71 constituted by an L-shaped engaging face, which is arranged to be engaged with the first throttle side engaging portion 51 of the first throttle lever 41; and the second choke side engaging portion 72 extending counterclockwise from the first choke side engaging portion 71, having an orthogonally downwardly bent distal end portion directed toward the main body 2 of the carburetor 1, thus forming an L-shaped configuration in profile, and arranged to be engaged with the second throttle side engaging portion 52 of the second throttle lever 42.

The first choke control lever 61 is urged, via the second choke control lever 62, to move in the direction to open the choke valve 30 by means of a torsion coil spring 80 that serves as a choke return spring, which is interposed between a spring-contacting pin 81 on the main body 2 of the carburetor 1 and the second choke control lever 62.

The first choke control lever 61 is provided with a lever portion 61A, to which the rotating manipulation of the choke on-off thumbscrew 155 is transmitted by way of a linkage member 171 (a cable or link rod), a coupling 172 and a link pin 173, and with a press-engaging portion 73 that extends in the direction opposite to that of the lever portion 41A and has an orthogonally downwardly bent distal end portion directed toward the main body 2 of the carburetor 1, thus forming an L-shaped configuration in side profile that is engageable with an inner end face 62*a* of the second choke control lever 62 by an urging force of the torsion coil spring 80.

Figure 1:
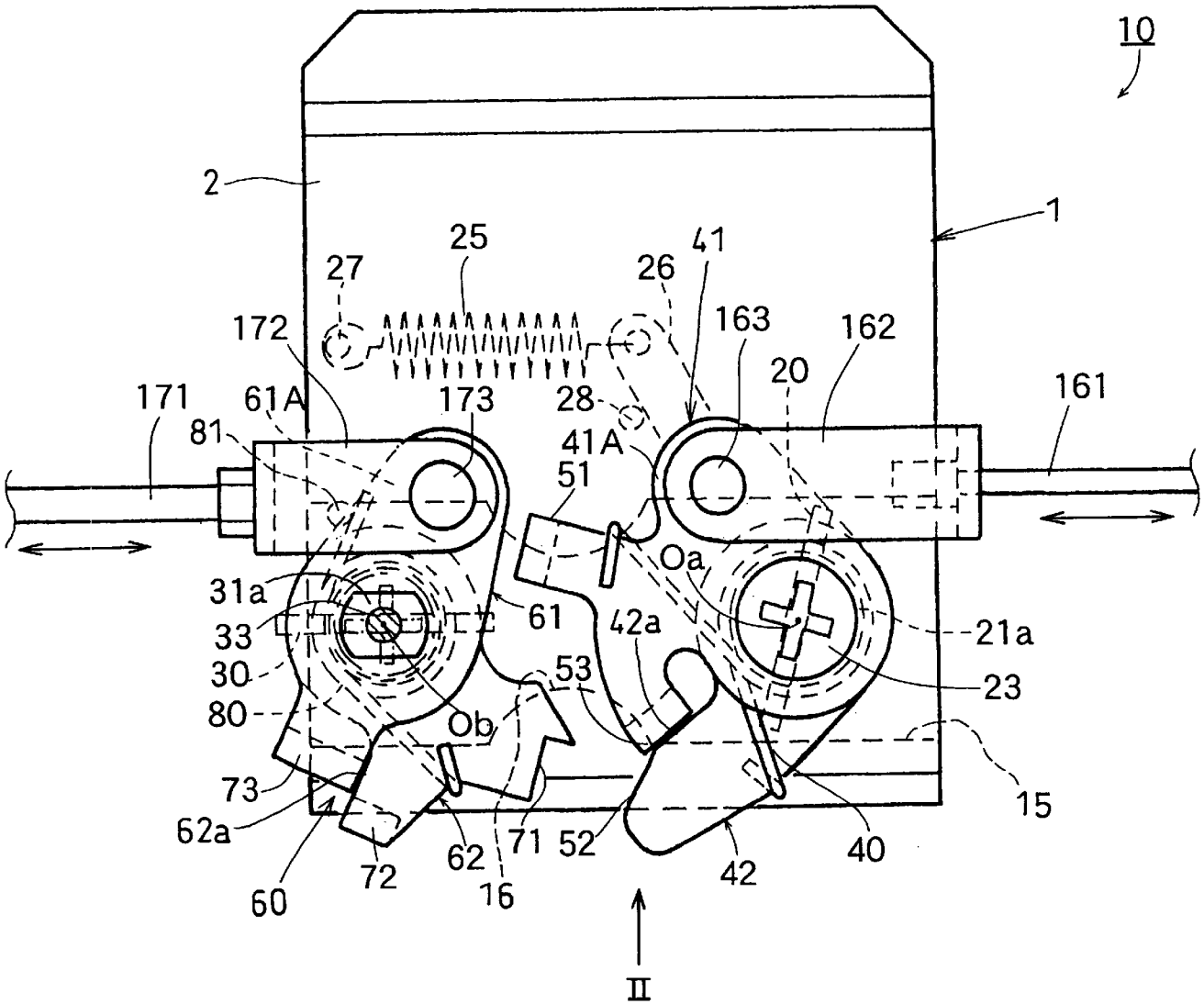
FIG. 1 is a left side view showing one embodiment of the engine intake control mechanism according to the present invention.
Figure 3:
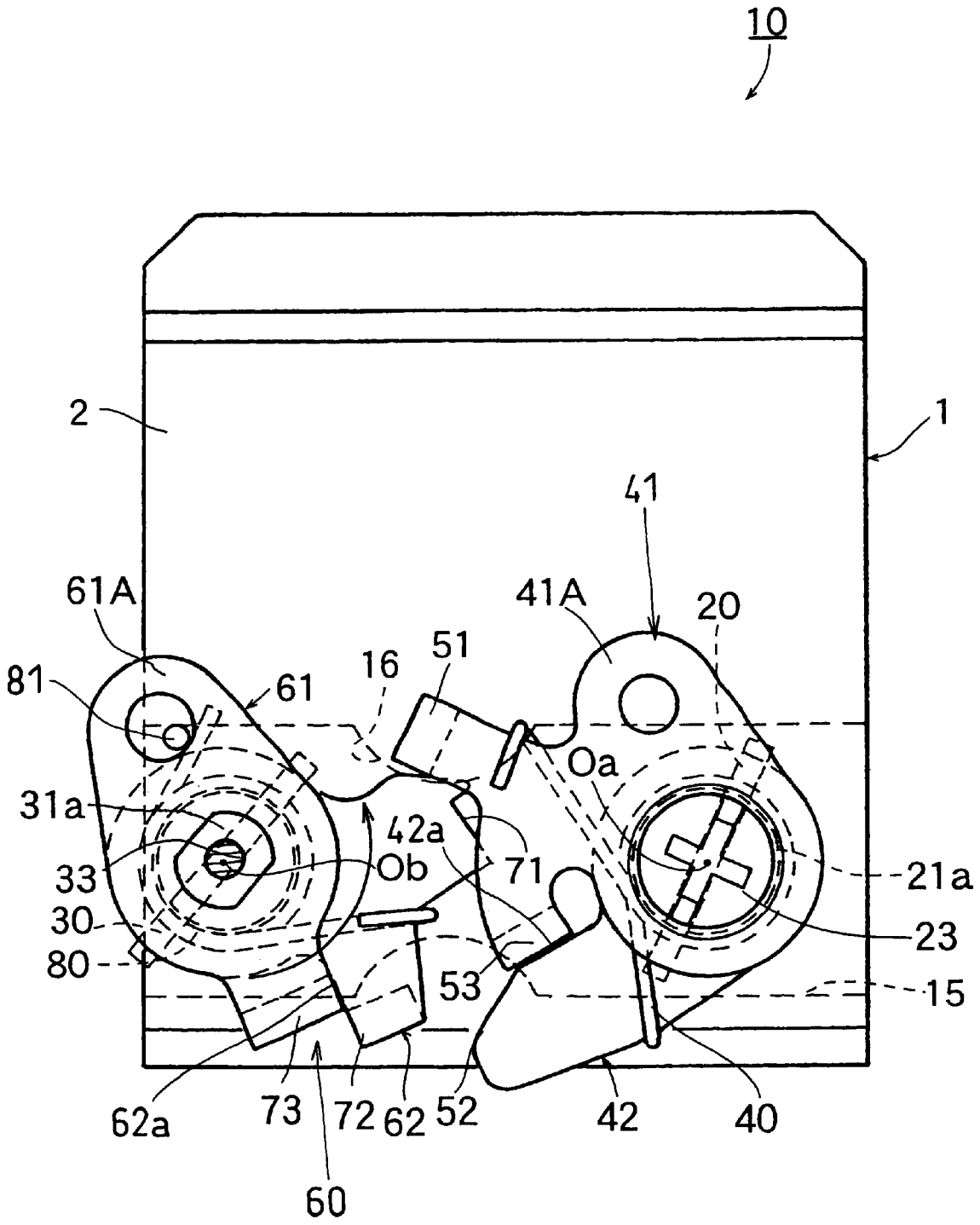
FIGS. 3 to 9 are side views that show the positions of the engine intake control mechanism shown in FIG. 1 at various stages in its operation.
Figure 4:
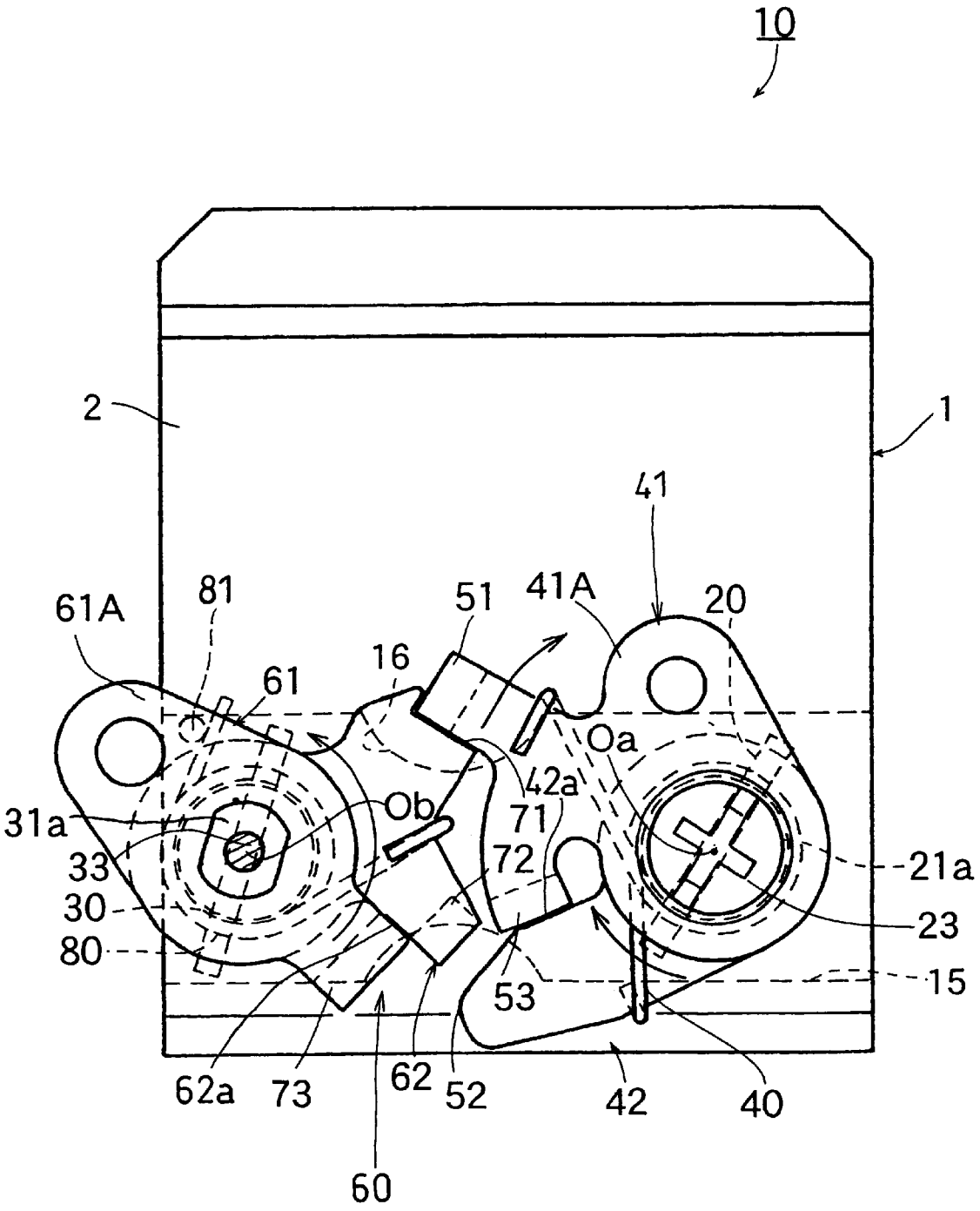

Cold-starting of engine begins by rotation of the choke on-off thumbscrew 155, which rotates via the linkage 171, 172 the first choke control lever 61 and the second choke control lever 62 counterclockwise against the bias of the torsion coil spring 80 from the normal full open position shown in FIG. 1. As shown in FIGS. 3 and 4, the choke valve 30 rotates with the choke control unit 60 via the torsion coil spring 80, thus moving it from the full open position to a nearly closed, cold-starting position. At the same time, the first choke side engaging portion 71 of the second choke control lever 62 of the: choke control unit 60 is brought into engagement with the first throttle side engaging portion 51 of the first throttle control lever 41 so as to rotate the first throttle control lever 41 clockwise against the bias of the throttle return coil spring 25 from the idling position so as to bring it into the cold-starting position, in which the throttle valve 20 is slightly more open than in the idling position. At the same time, the second throttle control lever 42, which is linked via the torsion coil spring 40 to the first throttle control lever 41, is also rotated so as to bring it into the cold-starting position. Ultimately, as shown in FIG. 4, the first choke side engaging portion 71 of the second choke control lever 62 and the first throttle side engaging portion 51 of the first throttle control lever 41 are interlocked with each other so as to retain the cold-starting positions thereof, resisting the biasing forces of the choke return spring 80 and of the throttle return spring 25.

Figure 5:
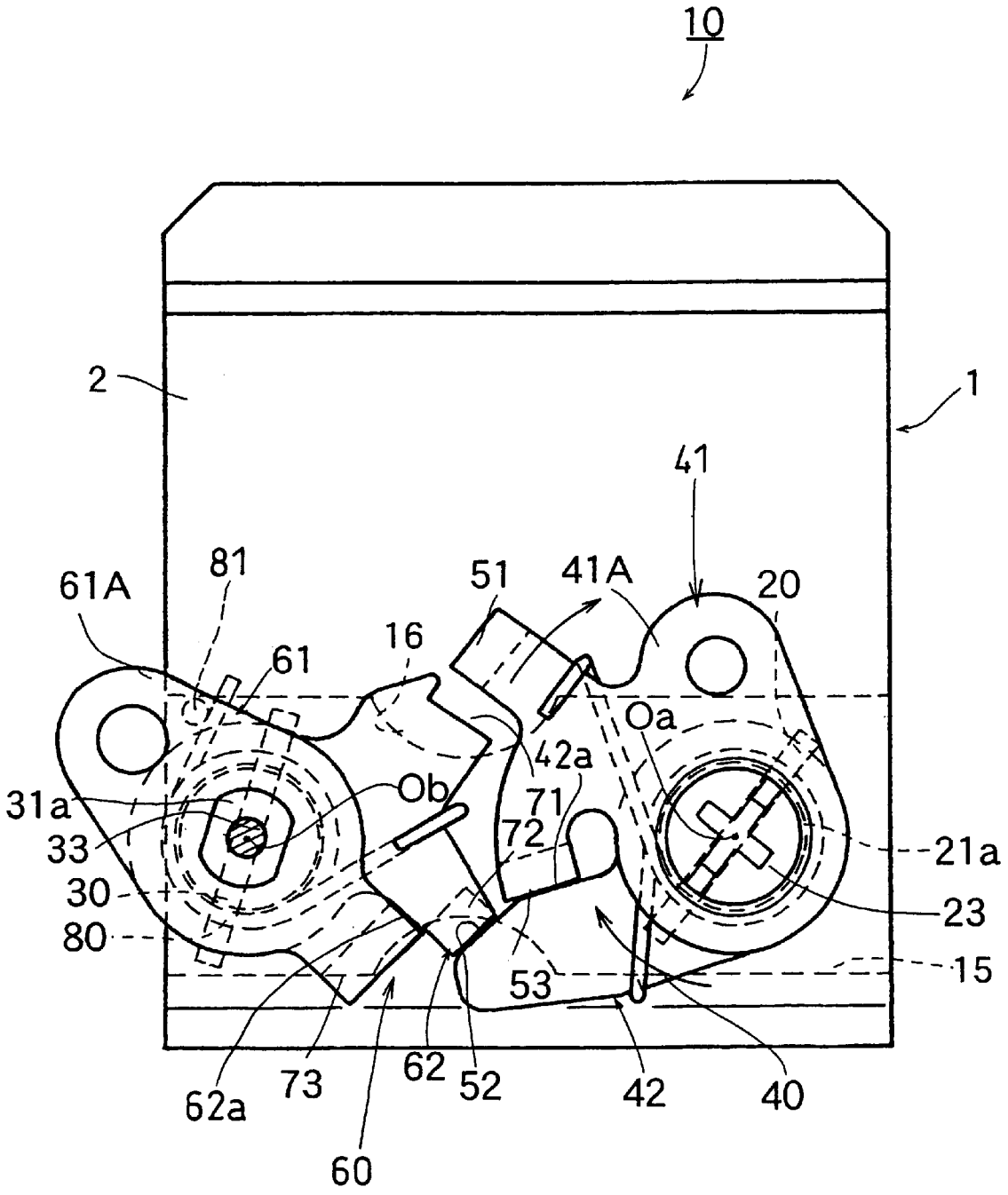

Next, the operator grips the top handle 130 of the chain saw 100 with his right hand and at the same time pulls the recoil starter handle 107 with his left hand so as to start the engine 120. When the throttle lever 152 attached to the top handle 130 (see FIG. 10) is squeezed, the first throttle control lever 41 is forced to rotate as shown in FIG. 5, via the linkage member 161, from the locked state of the throttle valve 20 in the direction to increase the opening degree of the throttle valve 20.

When the first throttle control lever 41 is rotated, the first throttle side engaging portion 51 of the first throttle control lever 41 is permitted to disengage from the first choke side engaging portion 71 of the second choke control lever 62. However, simultaneous with the disengagement, the second throttle side engaging portion 52 of the second throttle control lever 42 is brought to engage from below with the second choke side engaging portion 72 of the second choke control lever 62, so that the second throttle control lever 42 and the second choke control lever 62 are interlocked with each other so as to retain the cold-starting position of the choke valve 30.

Figure 6:
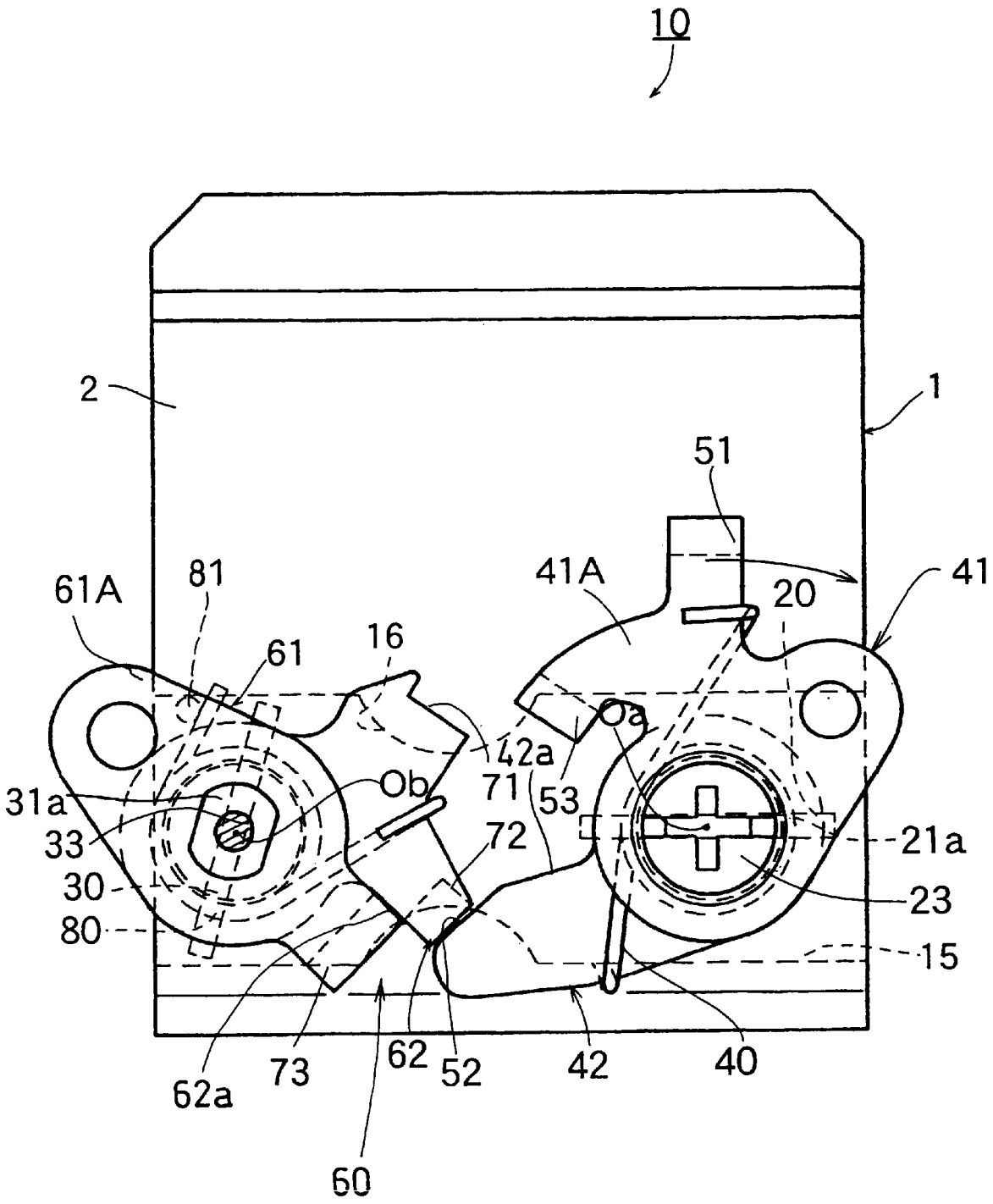

Even if the throttle lever 152 is forced to rotate further, as shown in FIG. 6, the second throttle control lever 42 and the choke control unit 60 are kept in their interlocked state at the cold-starting position. The first throttle control lever 41, however, is forced to rotate clockwise against the bias of the torsion coil spring 40 in the direction to move away from the second throttle control lever 42, resulting in the rotation of the throttle valve 20 in the direction to increase its opening degree.

As a result of these operations, the internal combustion engine 120 starts and is quickly warmed up enough to sustain combustion and to increase the engine speed, thus completing the cold-start.

Figure 7:
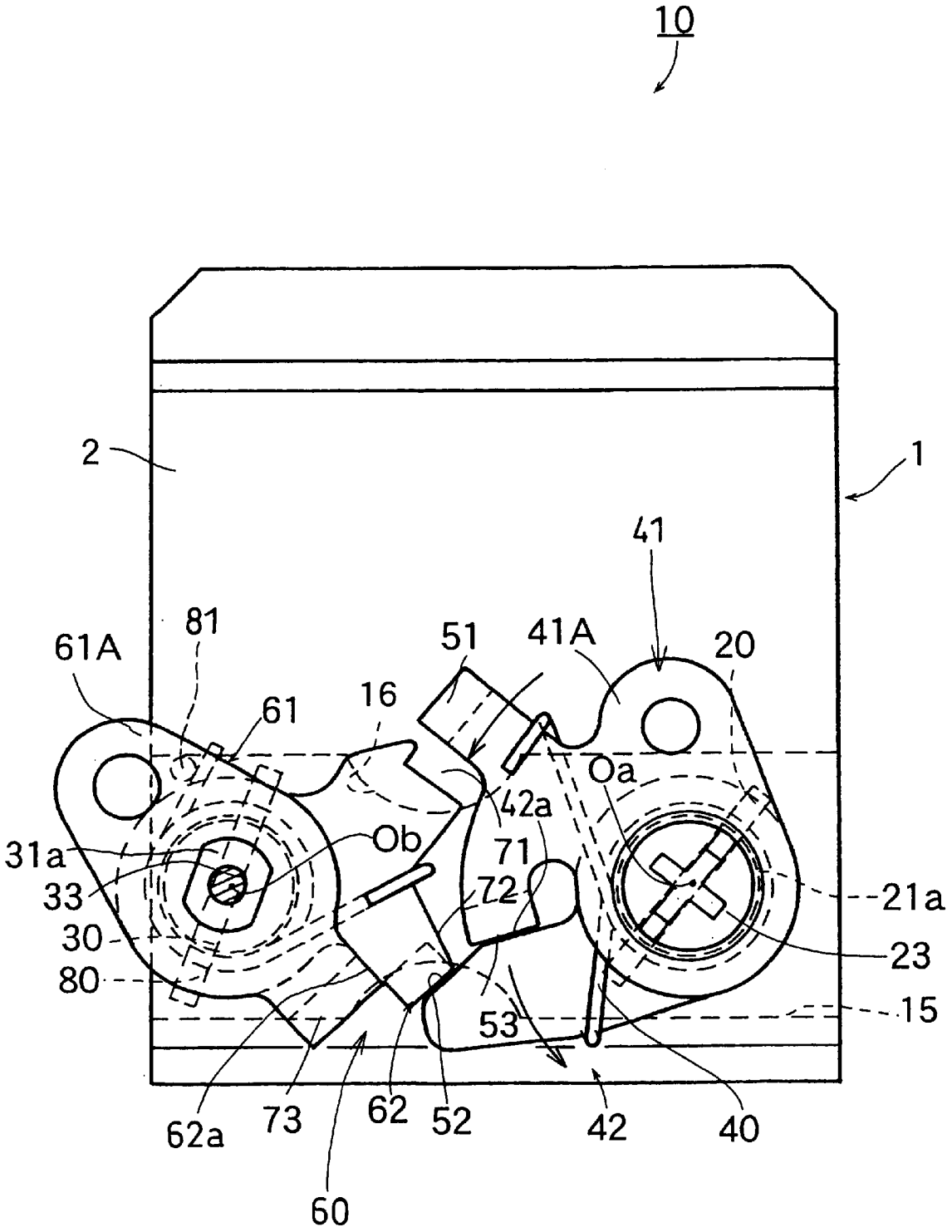
Figure 8:
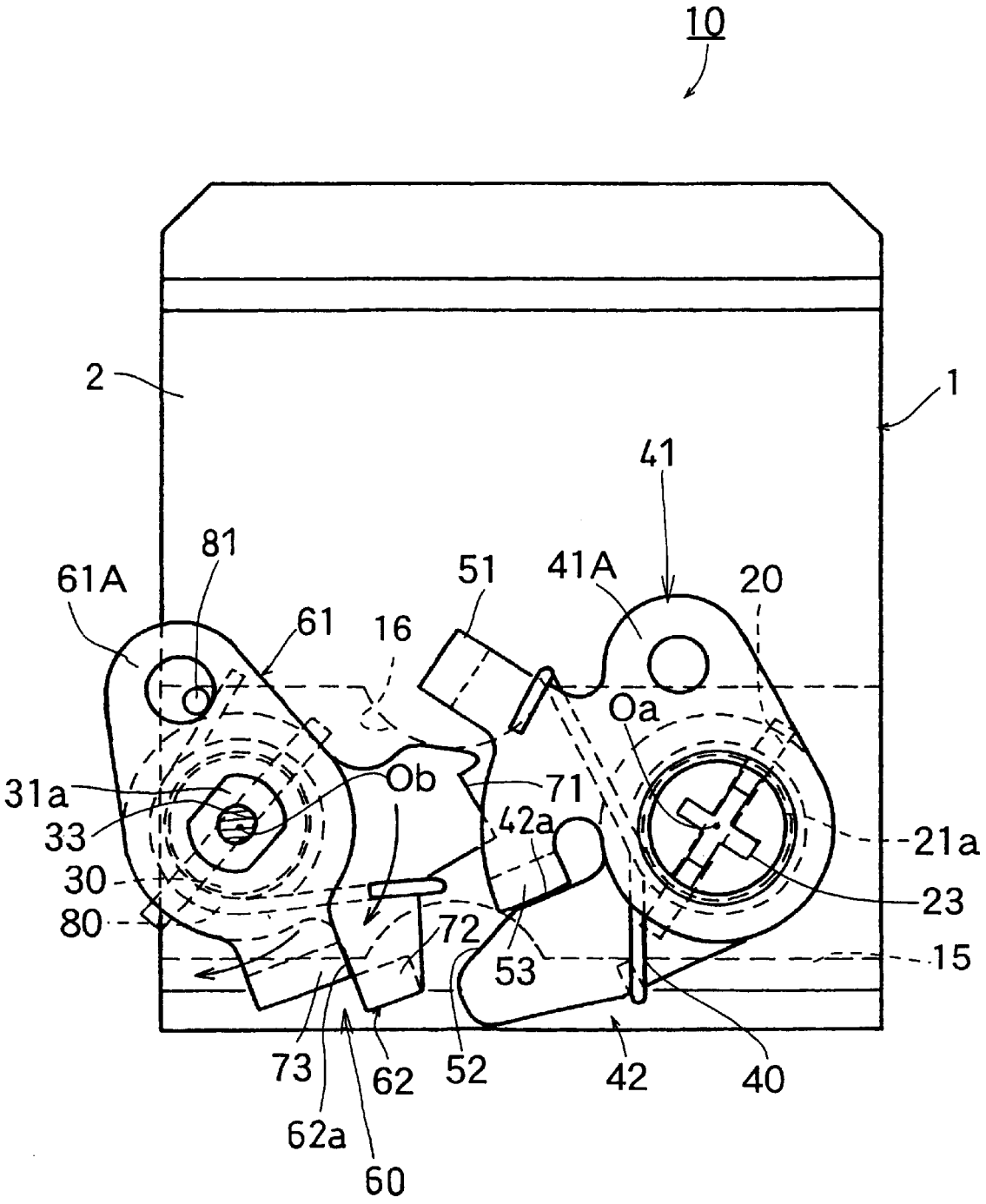
Figure 9:
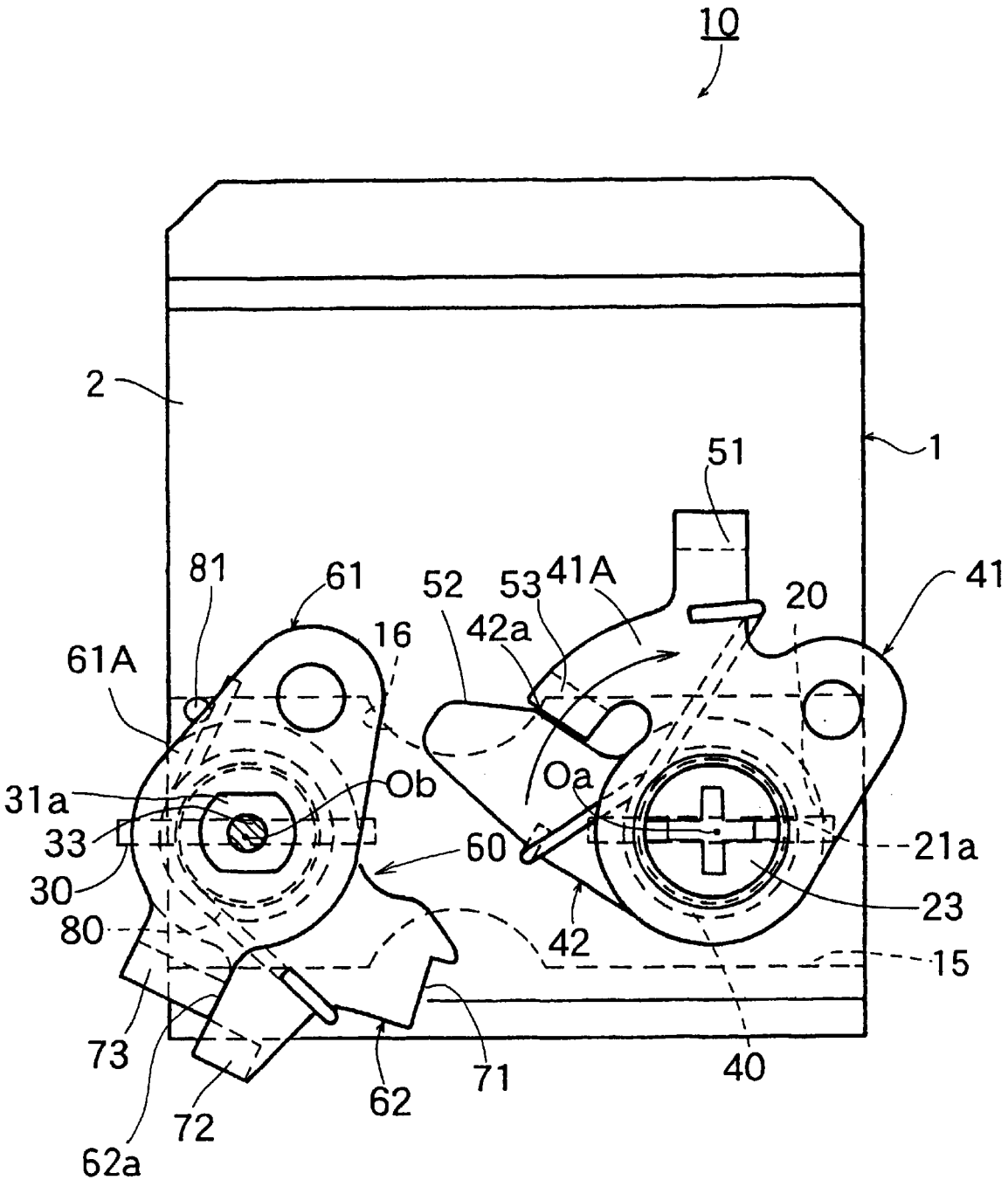

Thereafter, when the operator releases the throttle lever 152, the first throttle control lever 41 is forced to rotate, as shown in FIGS. 7 and 8, by the urging force of the throttle return coil spring 25 and the torsion coil spring 40 in a direction to close the throttle valve 20, thereby enabling the throttle valve 20 to return together with the second throttle control lever 42 to its original position, the position where the throttle valve 20 is in the idling position. As a result, the choke control unit 60 is released from its locked state, thereby enabling it to return, by the urging force of the choke return torsion coil spring 80, to its original normal open position. At the same time, the choke on-off thumbscrew 155 is also permitted to return to its original position.

Subsequently, when the throttle lever 152 is gripped again by the operator under the condition wherein the choke on-off thumbscrew 155 and the choke control unit 60 are at the normal rest position while the internal combustion engine 120 is idling, the first throttle control lever 41 as well as the second throttle control lever 42 are forced to rotate, without being engaged with the choke control unit 60, in the direction to open the throttle valve 20 to a suitable extent, depending on the magnitude of the rotation of the throttle lever 152.

With the engine intake control mechanism 10 of the present invention, at the time of cold-starting, the throttle valve 20 can be rotated in response to the closing movement of the choke valve 30 so as to bring it into the cold-starting position thereof, and at the same time, even if the throttle valve 20 is actuated so as to increase the opening degree thereof, the choke valve 30 can be retained at the cold-starting position. Thereafter, only when the throttle valve 20 is actuated to return to its original closed position is the choke valve 30 automatically returned to its original opened position. Therefore, even if the engine intake control mechanism 10 is adopted for use in the top handle type portable power working machine, it is possible to improve the cold-starting performance of the engine.

While the foregoing embodiment of the present invention has been explained in detail for the purpose of illustration, it will be understood that the construction of the device can be varied without departing from the spirit and scope of the invention.

For example, although the present invention has been explained in the above embodiment with reference to a chain saw, the present invention is also applicable to other kinds of portable power working machines, such as a power cutter and a hedge trimmer.

What is claimed is:

1. An engine intake control mechanism comprising:

a throttle valve and a choke valve which are positioned in an intake passageway of an air/fuel mixing device adapted to be mounted on an internal combustion engine;

a first throttle control lever coupled for rotation with a rotatable shaft of the throttle valve;

a second throttle control lever, which is rotatable about an axis of the rotatable shaft of the throttle valve;

a throttle return spring urging the throttle valve to rotate in the closing direction thereof;

a coupling spring linking the first throttle control lever to the second throttle control lever to enable the first throttle control lever and the second throttle control lever to rotate together;

a choke control unit coupled for rotation with a rotatable shaft of the choke valve; and a choke return spring urging the choke valve to rotate in the opening direction thereof, wherein the choke control unit is arranged such that when the choke control unit is rotated together with the choke valve so as to move the choke valve into a cold-starting position, the first throttle control lever together with the throttle valve and the second throttle control lever are caused to rotate in response to the rotation of the choke control unit so as to position the throttle control valve in a cold-starting position, the choke control unit and the first throttle control lever are interlocked with each other so as to retain the cold-starting positions thereof against the biasing forces of the choke return spring and of the throttle return spring, and when the first throttle control lever is further rotated from the interlocked state in a direction to increase the opening degree of the throttle valve, the first throttle control lever is disengaged from the choke control unit and at the same time the choke control unit is engaged with the second throttle control lever, thereby interlocking the choke control unit with the second throttle control lever at the cold-starting position.

2. The engine intake control mechanism according to claim 1, wherein the coupling spring is a torsion coil spring which is interposed between the first throttle control lever and the second throttle control lever.

3. The engine intake control mechanism according to claim 1, wherein the first throttle control lever is provided with a first throttle side engaging portion which is arranged to be engaged with the choke control unit and a press-engaging portion which is arranged to be releasably engaged with the second throttle control lever by the biasing force of the coupling spring.

4. The engine intake control mechanism according to claim 3, wherein the second throttle control lever is provided with a second throttle side engaging portion which is arranged to be engaged with the choke control unit.

5. The engine intake control mechanism according to claim 4, wherein the choke control unit is provided with a first choke side engaging portion which is arranged to be engaged with the first throttle side engaging portion, and a second choke side engaging portion which is arranged to be engaged with the second throttle side engaging portion.

6. The engine intake control mechanism according to claim 5, wherein the choke control unit is provided with a first choke control lever which is arranged to rotate with the rotatable shaft of the choke valve and a second choke control lever which is arranged to rotate about an axis of the rotatable shaft of the choke valve, and wherein the second choke control lever is provided with the first choke side engaging portion and the second choke side engaging portion, and wherein the first choke control lever is urged, by means of a choke return spring and via the second choke control lever, to move in a direction to open the choke valve.

7. The engine intake control mechanism according to claim 6, wherein the choke return spring member is a torsion coil spring which is interposed between the main body of the air/fuel mixing device and the second choke control lever.

* * * * *